US008674801B2

(12) United States Patent
Gerfer

(10) Patent No.: US 8,674,801 B2
(45) Date of Patent: Mar. 18, 2014

(54) INDUCTION COMPONENT

(75) Inventor: Alexander Gerfer, Odenthal (DE)

(73) Assignee: Wuerth Electronik EiSos GmbH & Co. KG

( * ) Notice: Subject to any disclaimer, the term of this patent is extended or adjusted under 35 U.S.C. 154(b) by 0 days.

(21) Appl. No.: 13/088,649

(22) Filed: Apr. 18, 2011

(65) Prior Publication Data

US 2011/0267163 A1 Nov. 3, 2011

(30) Foreign Application Priority Data

Apr. 28, 2010 (DE) ..... 10 2010 028325

(51) Int. Cl.
*H01F 17/04* (2006.01)
*H01F 27/02* (2006.01)

(52) U.S. Cl.
USPC ..... 336/221; 336/83; 336/92; 336/90; 336/96

(58) Field of Classification Search
USPC ..... 336/83, 92
See application file for complete search history.

(56) References Cited

U.S. PATENT DOCUMENTS 4,245,207 A 1/1981 Murakami et al.
6,950,002 B2 * 9/2005 Sano ..... 336/83
2002/0190830 A1 * 12/2002 Matsumoto et al. ..... 336/83
2005/0001705 A1 * 1/2005 Watanabe ..... 336/83
2006/0022788 A1 * 2/2006 Sasamori et al. ..... 336/208
2006/0284716 A1 12/2006 Yamaguchi
2007/0018770 A1 * 1/2007 Kamio ..... 336/221
2007/0146110 A1 * 6/2007 Oki ..... 336/232
2008/0290975 A1 * 11/2008 Watanabe ..... 336/90

FOREIGN PATENT DOCUMENTS

DE 69528322 T2 5/2003
DE 10 2007 063 170 A1 6/2009
JP 11135331 A 5/1999
JP 2004-103815 A 4/2004
WO 2009/077093 A1 6/2009

* cited by examiner

*Primary Examiner* — Elvin G Enad
*Assistant Examiner* — Ronald Hinson
(74) *Attorney, Agent, or Firm* — Boyle Fredrickson, S.C.

(57) ABSTRACT

An element for forming an induction component contains a coil body with a core and two radially projecting flanges, which are formed on the respective axial ends of the core and of which the one flange is designed to be attached to a printed circuit board and is larger than the other flange. On its outer side, the coil body is surrounded by a shielding ring, which sits on the larger of the two flanges. To this end, the shielding ring has an inwardly directed step on the lower end corner, the one limb of which step forms an abutment surface to be placed on the inner side of the flange. The other limb forms an abutment surface to be placed against the outer edge of the flange. The step preferably runs over the entire circumference of the shielding ring. As a result, an air gap formed between the upper flange and the inner side of the shielding ring is fixed in terms of its dimensions and position.

7 Claims, 2 Drawing Sheets

INDUCTION COMPONENT

This application claims the priority of the German patent application No. 102010028325.8. The whole disclosure of this prior application is herewith incorporated by reference into this application.

The invention relates to an induction component and a body for producing such an induction component.

Induction components are frequently required in electronics. They contain a ferrite core and at least one coil wound around the ferrite core. The arrangement is then surrounded by external shielding. The induction components are embodied such that they can be attached to a printed circuit board, with an electrical connection also being established at the same time as the attachment.

In a known induction component of this type (U.S. Pat. No. 6,847,280), provision is made for a two-part housing, which has both the shielding and the core for the coil. The ends of the wire forming the coil are routed to the outside through lateral openings.

An inductor component in which a coil core with two flanges is surrounded by shielding is likewise known, with an intermediate ring made of insulating material being arranged between the edge of the flanges, which are of the same dimensions, and the shielding ring (DE 10212930).

Now, there are also induction components, in which there is an air gap within the magnetic circuit for maintaining specific electrical properties. Since this air gap has an effect on the electrical properties of the induction component, it must be ensured that the air gap always has the correct dimensions. For this purpose, it has previously been proposed to arrange an induction component with a coil body and shielding within a plastic housing, and to house alignment means in the plastic housing, which alignment means align both the coil body and the shielding with respect to the plastic housing and thereby also bring about a mutual positioning between the coil body and the shielding (DE 102007063170).

The invention is based on the object of developing an option for ensuring the correct dimensions of an air gap in an induction component.

In order to achieve this object, the invention proposes an induction component with the features specified in claim 1. Developments of the invention are the subject matter of the dependent claims.

The induction component proposed by the invention thus contains a coil body and, surrounding the latter, a shielding ring which serves for shielding. The coil body in turn contains a core, which is usually, but not necessarily, cylindrical and around which the coil is wound. A flange is formed at at least one axial end, which flange has an inner side facing the coil core and an opposing outer side. This flange delimits the space in which the coil is arranged. The shielding ring, which delimits an air gap with respect to the coil body at at least one point, is now positioned with respect to the flange with the aid of positioning means such that the air gap has the envisaged dimensions and arrangement. In this case, the positioning means act directly between the shielding ring and the flange. An additional plastic housing is no longer required for this positioning and/or centering of the shielding ring.

The positioning means between the shielding ring and the flange associated therewith can be realized by compatible geometric embodiments of the shielding ring and/or the flange. Since the two objects are metallic or metal-like materials, the invention proposes to design the geometric embodiment as simple as possible.

In a development of the invention, provision can be made for the shielding ring to have an inner step on its end corner facing the flange, the one limb of which step forming an abutment surface to be placed onto the flange. The other limb of the inner step can then form an abutment surface to be placed against the edge corner of the flange. As a result, this step, which is matched to the dimensions of the flange, forms a positioning means, which centres and positions the shielding ring such that the air gap between the coil body and the shielding ring thereby obtains the correct dimensions and arrangement.

According to the invention, a development may provide for the coil body to have two flanges, arranged at a distance from the coil core, and for the air gap to be formed between the edge corner of the one flange and the inner wall area of the shielding ring.

According to the invention, a development may provide for the step at the end corner of the shielding ring to be provided over the entire circumference of the shielding ring. As a result, the shielding ring is secured against displacements in all directions.

In order also to secure the shielding ring against twisting, and to position it thereby, provision can be made, according to the invention, for the flange, with respect to which the positioning means are effective, to have an outer contour that deviates from a circle. By way of example, provision can be made for the outer contour of the flange to have the shape of a circle with two parallel, straight-line flattenings.

According to the invention, if two flanges are present, a development may provide for the positioning means between the shielding ring and the flange to be provided at the flange that serves for attaching the induction component to the printed circuit board. This flange also has a greater extent in the radial direction than the opposing flange.

Further features, details and advantages of the invention emerge from the claims and the abstract, the wording of both being included in the contents of the description by reference, from the following description of preferred embodiments of the invention and from the drawing, in which:

Figure 1:
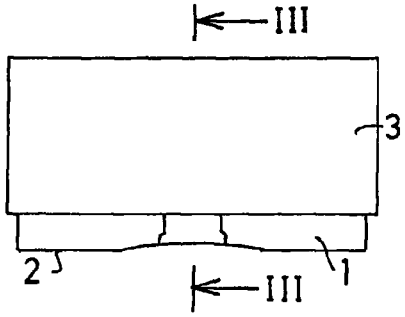
FIG. 1 shows a side view of an induction component according to the invention.

The induction component illustrated in a side view in FIG. 1 contains a flange 1, the lower side 2 of which is embodied and designed to be attached using SMT to a printed circuit board. The shielding 3 can be seen above the flange 1, which shielding however, as will be demonstrated below, partly covers the edge of the flange 1.

Figure 2:
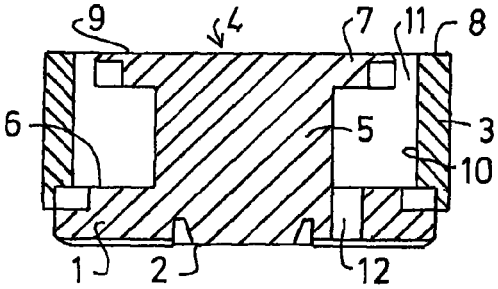
FIG. 2 shows a section along the line III-III in FIG. 1.

FIG. 2, to which reference is now made, shows a cross section through the illustrated component along the line III-III in FIG. 1. The component contains a coil body 4, which in turn contains a coil core 5. This coil core 5 is cylindrical and has a circular cross section. The previously mentioned flange 1 is formed on the axial lower end of the coil core 5, which flange has a planar inner surface 6 and the lower side 2. This flange delimits the space available to a coil. On the opposite end, the coil body 4 contains a second flange 7, which does not project as far in the radial direction as the lower flange 1.

The shielding ring 3 has been placed onto the lower flange 1, the upper end corner 8 of which shielding ring lying in a plane with the upper side 9 of the upper flange 7. An air gap 11 is formed between the edge of the upper flange 7 and the inner side 10 of the shielding ring 3. This air gap passes around the entire circumference without interruption.

The lower flange 1, the lower side 2 of which is embodied for attachment to a printed circuit board, contains a through-hole 12, which directly adjoins the outer circumference of the coil core 5. It serves for pressing through the end of the coil-forming wire, so that the latter can be soldered on the lower side.

Figure 3:
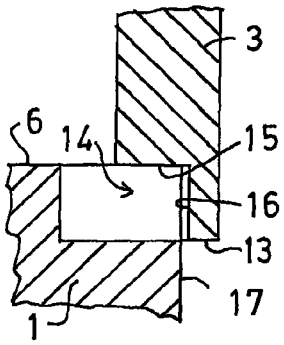
FIG. 3 shows a magnified detailed view of a part from FIG. 2.

As can already be gathered from FIG. 2, the shielding ring 3 rests on the inner side 6 of the lower flange 1. This can be seen more clearly in FIG. 3. On its lower end corner 13, the shielding ring 3 has an inwardly directed step 14. This step has a first limb 15, running parallel to the end corner 13, and a second limb 16, running perpendicular to said first limb and parallel to the outer side. The shielding ring 3 rests on the inner side 6 of the lower flange 1 with the first limb 15 of the step 14. The second limb 16 rests against the outer edge 17 of the lower flange 1. The distance between the outer edge 17 and the limb 16 has been drawn in a magnified fashion in FIG. 3 in order to illustrate the interaction more clearly.

Since the step 14 runs around the entire circumference of the shielding ring 3, this prevents the displacement of the shielding ring 3 with respect to the lower flange 1 in all directions.

Figure 4:
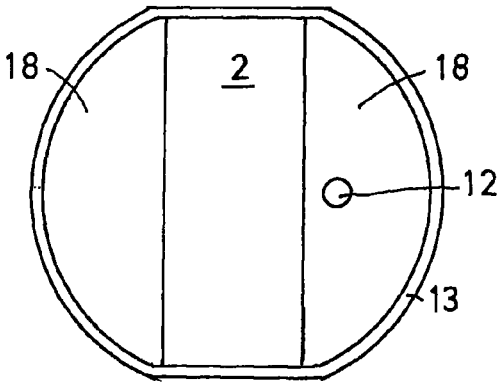
FIG. 4 shows a view of the induction component from below.

Attention is now turned to FIG. 4, which shows the induction component from the lower side. The lower side 2 is subdivided into three regions, specifically two outer regions with a conductive coating and a central region between the two coated regions 18, which central region remains coating free. The outer contour 17 of this lower flange 1 has the shape of two circular arcs, which are interconnected by two sections that run parallel to one another and in a straight line. This shape, which deviates from a circular shape, also prevents a twisting of the shielding ring 3 with respect to the flange 1.

The end corner 13 of the shielding ring 3 surrounds the outer contour 17 of the lower flange 1 from all directions.

Figure 5:
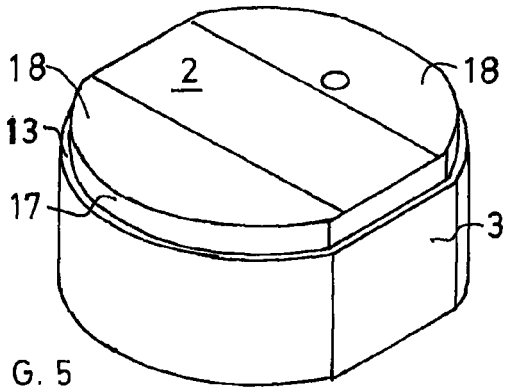
FIG. 5 shows a perspective view of the induction component from below.

The perspective view in FIG. 5 shows the induction component from below. This also shows that the lower end corner 13 of the shielding ring 3 surrounds the flange 1 everywhere.

Figure 6:
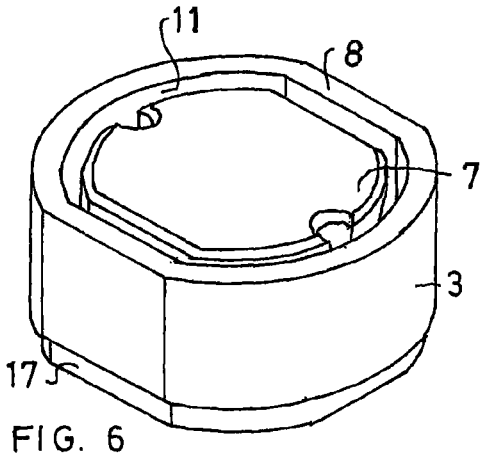
FIG. 6 shows a perspective view of the induction component from above.

FIG. 6 now shows, in a perspective illustration, the induction component from above. The air gap 11 formed between the flange 7 and the shielding ring 3 can be seen here. The subject matter of the present invention relates to correctly maintaining this air gap 11.

Figure 7:
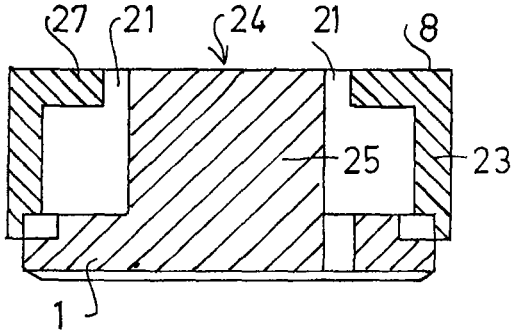
FIG. 7 shows a section corresponding to FIG. 2 through a modified embodiment of the induction component according to the invention.

Attention is now turned to the modified embodiment according to FIG. 7. A coil body 24 is illustrated here, in which the coil-body core 25 only has a flange 11 at its lower axial end, while it ends without a flange in the upper region. Instead, the shielding ring 23 has an inwardly directed, circumferential limb 27 in the region of its upper end corner 8. An air gap 21 is likewise formed between the inner corner of this limb 27 and the outer side of the coil-body core 25, which air gap is equally maintained in its correct dimensions and position as in the preceding embodiment. The positioning means formed by the step 14 between the lower flange 1 and the shielding ring 23 likewise serve for this purpose.

The invention claimed is:

1. Induction component, comprising
a coil body, which has
a coil core for holding the coil and
at least one flange, which projects radially from a bottom end of the cylindrical coil core to form an outer edge,
a shielding ring which surrounds the coil core, which is spaced laterally from the coil core and which,
together with the coil core, forms a circumferential air gap between the coil core and the shielding ring, the air gap commencing at a top of the coil core and extending down the side of the coil core to, and also with
positioning means formed on the outer edge of the flange for acting between the flange and a bottom edge of the shielding ring and for maintaining a constant lateral spacing providing the circumferential air gap and restricting axial withdrawal of the coil core.

2. Induction component according to claim 1, wherein the positioning means includes an inner shoulder of the shielding ring on a corner of the edge facing the flange, the one limb of which shoulder forming an abutment surface to be placed onto the flange and the other limb of which shoulder forming an abutment surface to be placed against the edge corner of the flange.

3. Induction component according to claim 1, wherein the coil body has two flanges spaced an axial distance apart relative to the coil core, and each extending a respective radial distance from the coil core, and wherein an air gap is formed between an edge corner of the one flange and the inner side of the shielding ring.

4. Induction component according to claim 2, wherein an outer contour of the flange and an inner contour of the shielding ring are non-circular to restrict twisting of the coil body relative to the shielding ring.

5. Induction component according to claim 3, wherein, in the case of two flanges, the positioning means are provided between the shielding ring and the flange, which is associated with a printed circuit board and serves for attachment purposes.

6. Induction component according to claim 1, wherein the flange is formed as a plate.

7. Induction component according to claim 2, wherein the shielding ring is made of a metallic or metal-like material and is separate from an external housing for the component.

* * * * *